US009598262B2

(12) United States Patent
Henke et al.

(10) Patent No.: US 9,598,262 B2
(45) Date of Patent: Mar. 21, 2017

(54) METHOD FOR ADAPTING A CHANGING MOVEMENT OF A THREAD TO A FLANGE SPOOL AND SPOOLING DEVICE

(71) Applicant: SSM Schärer Schweiter Mettler AG, Horgen (CH)

(72) Inventors: René Henke, Kaltbrunn (CH); Claudio Hofer, Richterswil (CH); André Wandeler, Samstagern (CH)

(73) Assignee: SSM Schärer Schweiter Mettler AG, Horgen (CH)

( * ) Notice: Subject to any disclaimer, the term of this patent is extended or adjusted under 35 U.S.C. 154(b) by 254 days.

(21) Appl. No.: 14/608,143

(22) Filed: Jan. 28, 2015

(65) Prior Publication Data

US 2015/0151946 A1 Jun. 4, 2015

Related U.S. Application Data

(63) Continuation of application No. PCT/EP2013/066012, filed on Jul. 30, 2013.

(30) Foreign Application Priority Data

Jul. 30, 2013 (DE) ..... 10 2012 214 051

(51) Int. Cl.
*B65H 54/12* (2006.01)
*B65H 54/28* (2006.01)
*B65H 54/38* (2006.01)

(52) U.S. Cl.
CPC ..... *B65H 54/12* (2013.01); *B65H 54/28* (2013.01); *B65H 54/2821* (2013.01); *B65H 54/385* (2013.01); *B65H 2701/31* (2013.01)

(58) Field of Classification Search
CPC .... B65H 54/12; B65H 54/28; B65H 54/2821; B65H 54/385; B65H 2701/31
See application file for complete search history.

(56) References Cited

U.S. PATENT DOCUMENTS

| | | | |
|---|---|---|---|
| 3,677,483 | A | 7/1972 | Henrich |
| 2007/0284472 | A1 | 12/2007 | Lammermann et al. |

FOREIGN PATENT DOCUMENTS

| | | | |
|---|---|---|---|
| CN | 1348426 | A | 5/2002 |
| CN | 1620398 | A | 5/2005 |
| CN | 101549808 | A | 10/2009 |
| DE | 2005 503 | | 8/1970 |
| DE | 1946 220 | | 3/1971 |

(Continued)

*Primary Examiner* — William E Dondero
(74) *Attorney, Agent, or Firm* — Hackler Daghighian Martinio & Novak

(57) ABSTRACT

A method for adapting a travel end position of a changing movement of a thread to a flange spool includes means of which the thread is moved back and forth during a spooling operation along a rotation axis of the flange spool relative to the flange spool by means of a changing thread guide. The flange-side travel end position can be moved away from the flange of the flange spool in an axial direction when the thread tension decreases when the thread is moved away from the flange-side travel end position. Also, the flange-side travel end position can be moved by means of the changing thread guide in an axial direction towards a flange of the flange spool when the thread tension increases when the thread is moved away from the flange-side travel end position. Included is a spooling device for carrying out the disclosed method.

8 Claims, 4 Drawing Sheets

(56) References Cited

FOREIGN PATENT DOCUMENTS

| | | | |
|---|---|---|---|
| DE | 24 43 734 | A1 | 6/1975 |
| DE | 26 00 511 | A1 | 7/1977 |
| DE | 10 206 018 428 | A1 | 10/2007 |
| GB | 1291764 | | 10/1972 |
| GB | 1 436 248 | | 5/1976 |
| JP | S648190 | A | 1/1989 |
| JP | 2003321244 | A | 11/2003 |
| TW | 201036907 | A1 | 10/2010 |
| WO | 00 39013 | A1 | 7/2000 |

METHOD FOR ADAPTING A CHANGING MOVEMENT OF A THREAD TO A FLANGE SPOOL AND SPOOLING DEVICE

CROSS-REFERENCE TO RELATED APPLICATIONS

This continuation application claims priority to PCT/EP2013/066012 filed on Jul. 30, 2013 which has published as WO 2014/023618 A1 and also the German application number 10 2012 214 051.4 filed on Aug. 8, 2012, the contents of which are fully incorporated herein with these references.

FIELD OF THE INVENTION

The invention relates to a method for adapting a changing movement of a thread, by means of which the thread is moved back and forth during a spooling operation along a rotation axis of a flange spool relative to the flange spool by means of a changing thread guide, to the flange spool, and a spooling device.

BACKGROUND OF THE INVENTION

In practice, threads, such as, for example, yarns, twines or other textile structures, for the further use thereof are generally wound on yarn carriers, so-called yarn spools. The spooling devices used generally comprise a supply mechanism for the yarn and a yarn spool retention member which can be driven in a motorized manner and on which the yarn spool which is intended to be wound with the thread is arranged. The yarn spool can be driven continuously via the yarn spool retention member. The thread to be wound is supplied to the yarn spool by means of a so-called changing device in order to wind the thread, for example, turn by turn (=parallel winding) in layers which are arranged precisely one above the other on the yarn spool. The changing device, in accordance with an established construction type, may have a changing thread guide which during the spooling operation can be moved back and forth by means of a pulling means in rapid succession along the longitudinal axis (=rotation axis) of the yarn spool relative thereto in an oscillating manner.

In order to control the spooling operation, the spooling devices conventionally have a control device having a thread tension sensor in order to monitor a thread tension of the thread during the spooling operation and to adjust it to a predetermined tension value. This is decisive for a high-quality winding result.

Flange spools are distinguished by a spool shaft which is provided at one end or also at both ends with a usually plate-like flange. This yarn spool type is principally used to provide yarns in machines of textile processing which wind a core yarn with one or more additional yarns. The yarn wound on the flange spool is generally removed from the flange spool over the periphery of the flange spool. Although the flange spools used commercially are generally produced completely or at least partially from metal, owing to their duration of use often lasting over several years, they are also subjected to a not insignificant level of wear. Owing to this wear of the flange spools, the spooling operation may be severely disrupted. This results in losses in terms of quality of the flange spool wound with the yarn. The flange spools may thus in particular have undesirable (variable) expansions of their flange hole, whereby the reproducible precise positioning thereof on a yarn spool retention member of the spooling device is made more difficult. Blockages of the spool shaft, flanges which are bent and/or displaced relative to each other in the case of flange spools which are constructed in several parts also impede uniform spooling of the generally very fine thread which has little tear-resistance on the flange spool.

DE 2005 503 A discloses a method and a device for controlling a spooling operation, in which the distribution of a thread on a flange spool is automatically controlled. The time of a flange-side change of the direction, that is to say, the travel end position, of the changing movement of a thread guide is controlled by means of an electronic circuit using the measured thread tension and the rotation speed of the flange spool when the thread guide is moved in the direction towards the flange of the flange spool in order thus to prevent undesirable flange-side accumulation or thinning of the thread winding in the region of the flange.

This method is not very suitable for precise spooling, in particular of very fine textile threads, in particular since the rotation speed of the flange spool which is intended to be wound with the thread changes only relatively late in the event of such incorrect winding. Furthermore, textile threads are in practice spooled with running speeds of from 500 m to approximately 2500 m per minute and a changing frequency of up to 5 Hz on the flange spool. With such a high changing and running speed, an adjustment of the flange-side travel end position in real time, that is to say, when the changing movement is carried out in the direction towards the travel end position-side flange of the flange spool, cannot be implemented in a reliable manner in terms of control technology. The winding process would consequently be highly susceptible to failure.

An object of the invention is to set out a method and a spooling device for adapting a changing movement of a thread to a flange spool which, even when a worn flange spool is used, enable particularly precise spooling of the thread on the flange spool and which can also be used in particular in the event of high-speed spooling operations and for very fine threads.

SUMMARY OF THE INVENTION

The object relating to the method is achieved with a method having the features set out in the patent claims. The object relating to the spooling device is achieved with a spooling device having the features set out in patent claims. Advantageous developments of the invention are set out in the dependent claims.

The method according to the invention enables precise adaptation of the changing movement of the thread to be spooled (wound) on the flange spool to the geometry of the flange spool to be wound with the thread and to the respective axial positioning of the flange spool on the rotation axis thereof. A sustained and undesirable high winding of the thread on the flange (thread winding) may also be counteracted, in the same manner as insufficient axial winding of the thread in the direction towards the flange. The flange-side travel end position of the changing movement of the thread may in this instance be adapted to the flange spool by means of the changing thread guide with only little complexity in terms of technical measurement. According to the invention, this is carried out based on measurement information relating to the thread tension, preferably alone, when the thread moves axially away from the flange-side travel end position. In order to adapt the flange-side travel end position, in the most simple case a (flange-side) basic travel which is predetermined for the changing thread guide with at the same time an unchanged travel central position of the changing thread guide can be reduced/increased accordingly. On the whole, it is thereby also possible to produce on a flange spool with the appearance of wear explained in the introduction a particularly uniform winding member. The winding member extends on the flange spool substantially in the desired manner precisely to the respective flange of the flange spool, or, in the case of a flange spool with two flanges, precisely from flange to flange of the flange spool. The winding member thereby has a high quality, whereby subsequent uniform removal of the thread from the flange spool is enabled and the risk of a thread breaking is reliably counteracted. The changing rate of the thread tension of the thread to be wound on the flange spool is in this instance preferably established within a defined time measurement range of the changing movement. The measurement range comprises in this instance in particular the time at which the flange-side travel end position is reached. That is to say, in the method according to the invention for travel position correction of the changing movement of the thread, an axially incorrect position of the flange-side travel end position of the changing movement—with respect to the flange of the flange spool—is deliberately accepted in order to adapt it subsequently by means of the changing thread guide precisely to the flange spool (that is to say, the axial position of the flange). The method according to the invention is thereby suitable in particular for winding very fine threads and suitable for high-speed spooling operations which are mentioned in the introduction, as are standard in the winding and rewinding of textile threads on flange spools.

The flange-side reverse location, in the event of a changing rate of the thread tension which is larger/smaller than the predetermined desired changing rate, is preferably adapted to the flange spool. In the event of only a changing rate of the thread tension which is smaller than the predetermined desired changing rate, the flange-side travel end position can also be adapted to the flange spool. As long as the thread tension drops (decreases) when the thread moves away from the flange-side travel end position, that is to say, within the respective measurement range for determining the changing speed of the thread tension, the flange-side travel end position of the changing movement is moved away in an axial direction from the flange of the flange spool. To this end, for example, the flange-side travel of the changing thread guide can be reduced with respect to a travel central position of the changing thread guide. A predetermined flange-side basic travel of the changing thread guide is consequently reduced. As long as the thread tension increases within the measurement range, that is to say, when the thread moves away from the flange-side travel end position, the flange-side travel end position is moved in an axial direction closer to the flange. That is to say, the flange-side travel end position in this instance is moved closer to the corresponding flange for the subsequent spooling operation. To this end, the flange-side (basic) travel of the changing thread guide, with respect to the travel central position of the changing thread guide, can be increased accordingly.

The travel end position of the thread, which position is adapted to the flange spool in the manner described above, is predetermined by the control device for the subsequent spooling operation and where applicable is adapted to the flange spool again in the manner described above. This may be necessary in particular in the case of a bent flange or a compressed flange spool.

According to the invention, the changing rate of the thread tension is arithmetically averaged by means of a defined time measurement range. The size of the measurement range can advantageously be determined in accordance with the changing speed of the thread.

An axial incorrect position of the flange-side travel end position relative to the flange of the flange spool can be identified according to the invention in an even more reliable manner by the changing rate of the thread tension additionally being established when the thread is moved towards the flange-side travel end position with reference to the established thread tension. The flange-side travel end position is in this instance adapted to the flange spool if the changing rate of the thread tension when the thread is moved towards the flange-side travel end position and when it is moved away from the flange-side travel end position deviates from the predetermined desired changing rate (in terms of value) in the manner defined.

According to a preferred development of the invention, the flange-side travel end position (=the reverse locations of the changing movement) and the flange spool are axially adjusted relative to each other by means of the changing thread guide only when the thread tension in the region of the flange-side travel end position (additionally) deviates in a defined manner from a predetermined thread tension limit value or the thread tension in the region of the flange-side travel end position is outside a predetermined thread tension tolerance range.

When the thread tension in the flange-side travel end position has a tension peak which is greater than a predetermined maximum thread tension limit value and/or the tension peak is above the predetermined thread tension tolerance range, this can be evaluated as an indication of an excessively large travel of the changing movement of the thread. In this instance, the thread is wound to a high state on the flange.

If the thread tension has an above-mentioned tension peak (only) when moving the thread away from the flange-side travel end position, this can be evaluated as an indication of an excessively small travel of the changing movement. In this instance, the thread is not wound on the flange spool axially far enough in the direction towards the flange of the flange spool. In this instance, the thread tension during the axial movement of the thread in the direction towards the flange-side travel end position may in addition be smaller than a predetermined minimum thread tension limit value or may fall below the predetermined thread tension tolerance range.

On the whole, the sensitivity and specific nature of the method according to the invention can thereby be improved with respect to the recognition of an axial incorrect position of the flange-side travel end position (reverse location) of the thread relative to the axial position of the flange of the flange spool. Furthermore, it is thereby possible to achieve an even lower level of susceptibility to failure of the method.

The respective thread tension limit value and/or the thread tension tolerance range may according to the invention be fixedly stored in the control device before the beginning of the spooling operation. Alternatively, the respective thread tension limit value can be determined during the spooling operation, preferably by means of an averagely measured maximum/minimum thread tension of the thread during the spooling operation.

As a desired changing rate of the thread tension, it is possible in particular to predetermine a mean changing rate of the thread tension of the thread, which rate is established during the spooling operation.

The spooling device according to the invention for spooling a thread on a flange spool comprises:

a supply spool for providing the thread which is intended to be wound on the flange spool, a yarn spool retention member which can be driven in a continuous manner for the flange spool;

a control device having a thread tension sensor for the time-resolved detection of a thread tension of the thread which is intended to be wound on the flange spool; and a changing thread guide which can be moved back and forth in a changing manner relative to the yarn spool retention member. The control device is programmed to carry out the method described above.

The changing thread guide is preferably secured to an in particular continuous pulling means which is guided so as to be able to be moved back and forth around redirection rollers. The redirection rollers may also be constructed as redirection wheels.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
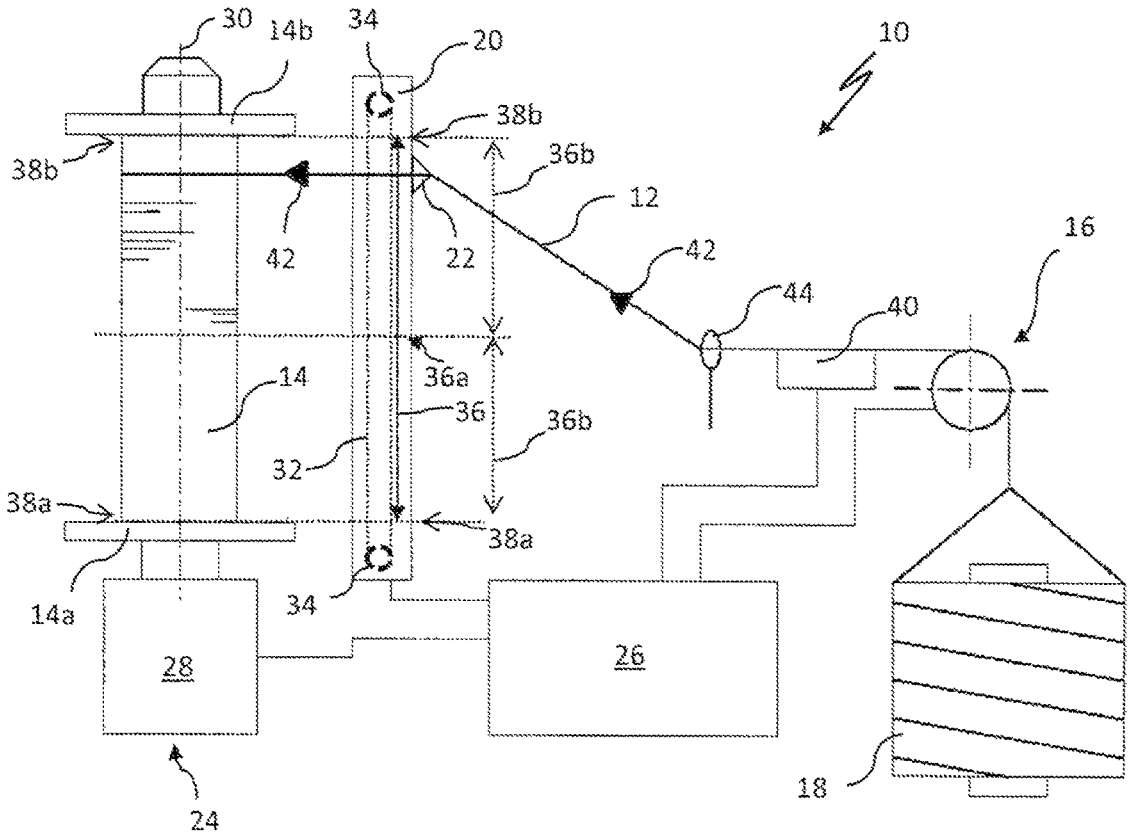
FIG. 1 is a block diagram of a spooling device according to the invention for winding a thread on a flange spool, having a changing device by means of which the thread which is intended to be supplied to the flange spool can be moved back and forth with respect to the flange spool along the rotation axis thereof between two reverse locations, the spooling device having a control device having a thread tension sensor.

FIG. 1 shows a spooling device 10 for spooling a thread 12 on a flange spool 14, with in this instance two terminal flanges 14*a*, 14*b*. The spooling device 10 comprises a thread delivery mechanism 16 and a supply spool 18 for providing the thread 12 which is intended to be wound on the flange spool 14, a changing device 20 having a changing thread guide 22, a yarn spool retention device 24 for the flange spool 14 and a control device 26.

The yarn spool retention device 24 has a drive motor 28 for continuously driving the flange spool 14 about the rotation axis 30 thereof (=longitudinal axis of the flange spool 14). The thread 12 can in this instance be removed (only) by rotating the flange spool 14 from the supply spool 18 at the upper side. The supply spool 18 may in addition be able to be driven in a motorized manner and/or may have a braking device which is not shown in greater detail in FIG. 1. In this instance, the thread can be removed at the peripheral side from the supply spool 18 (not shown).

The changing thread guide 22 is secured to a pulling means 32 which can be driven in a motorized manner and which is guided around redirection rollers 34. The redirection rollers 34 and the pulling means 32 are illustrated in FIG. 1 with broken lines. The pulling means 32 in this instance is constructed as a continuous pulling means. The changing thread guide 22 can be moved back and forth together with the thread 12 which is guided thereon by means of a changing movement 36 in the direction of the rotation axis 30 of the flange spool 14 between two travel end positions 38*a*, 38*b* which are spaced apart from each other in rapid succession. A travel central position of the changing thread guide is designated 36*a*. The spacing between the travel central position 36*a* and the two travel end positions 38*a*, 38*b* corresponds to a respective travel 36*b* of the changing thread guide 22. The thread 12 which is intended to be supplied to the flange spool 14 can thereby be deposited (wound) on the flange spool between the two travel end positions 38*a*, 38*b* on the flange spool 14. The travel end positions 38*a*, 38*b* of the changing movement 36 consequently correspond to lateral reverse locations of the thread movement relative to the rotation axis 30 of the flange spool 14. The control device 26 serves to control the entire spooling operation, in particular also the changing movement of the changing thread guide 22. The control device 26 has a thread tension sensor 40 which is arranged in the running direction 42 of the thread 12 directly, that is to say, without any other intermediate thread guiding and/or thread redirection means, in front of a guiding portion 44 which is constructed as a guiding eyelet. The guiding portion 44 is arranged in a fixed manner with respect to the yarn spool retention member 24. The changing thread guide 22 is arranged directly downstream of the guiding portion 44 in the running direction 42 of the thread 12.

Figure 2:
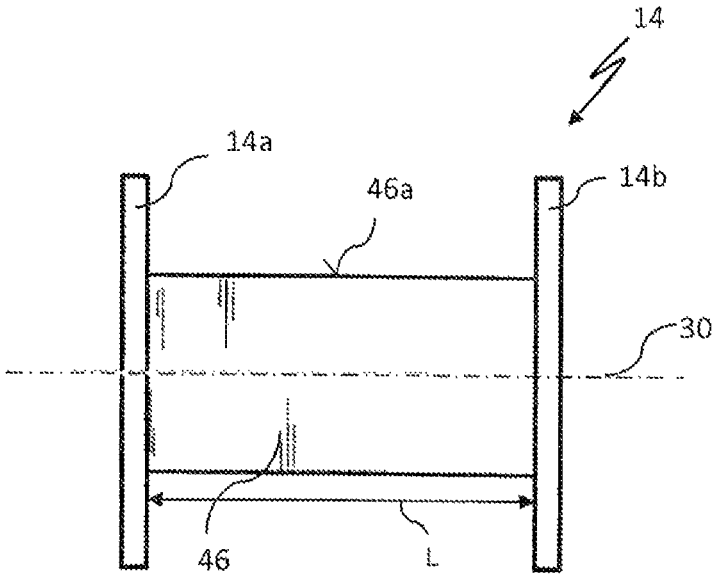
FIG. 2 is a side view of the flange spool from FIG. 1 with a thread which is wound thereon in an optimum manner.

In FIG. 2, a flange spool 14 is illustrated in greater detail as a side view. The thread 12 is wound on the flange spool 14 in an optimum manner over the entire axial length L of the flange spool 14, which length can be wound with the thread 12. The thread 12 forms on the flange spool 14 a winding member 46 having an outer contour 46*a* which is constructed so as to be generally parallel with the rotation axis 30 of the flange spool 14. The winding member 46 extends from the flange 14*a* to the flange 14*b* of the flange spool 14 and is in abutment with both flanges 14*a* 14*b* at the inner side.

In practice, as explained in the introduction, owing to wear or damage to the flange spool 14, incorrect winding of the thread 12 on the flange spool 14 may occur when the (flange-side) travel end positions 38*a*, 38*b* of the changing thread guide 22 during the spooling operation in an axial direction are not aligned precisely with respect to the axial position of the flanges 14*a*, 14*b* of the flange spool 14 along/on the rotation axis 30.

Figure 3:
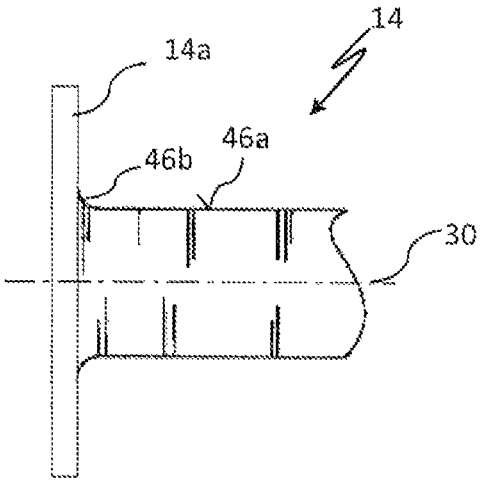
FIG. 3 is a partial side view of the flange spool from FIG. 1 in which the thread, owing to a flange-side travel end position of the changing thread guide, which position is incorrect since it is arranged axially too far to the left in the figure, is wound to a high state on the flange of the flange spool.

With a flange-side travel end position 38*a*, 38*b* which, with respect to the flange 14*a*, 14*b* of the flange spool 14, which flange is in each case associated with the travel end position 38*a*, 38*b*, is arranged too far towards the outer side in an axial direction, the thread 12 when the flange spool 14 is driven in a continuous manner, is wound to a high state at the inner side on the flange 14*a*, 14*b*, as illustrated as a cutout in FIG. 3. The winding member 46 produced then has an outer contour 46*a* with a winding member flank 46*b* which increases in a concave manner in the direction towards the flange 14*a*, 14*b*, that is to say, a so-called undesirable thread winding.

Figure 4:
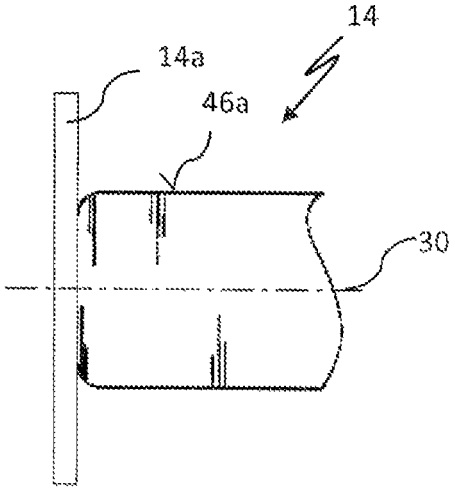
FIG. 4 is a partial side view of the flange spool from FIG. 1 in which the thread, as a result of a flange-side travel end position of the changing thread guide, which position is excessively remote from the flange axially, is not wound on the flange spool as far as the flange.

FIG. 4 is a partial side view of a flange spool 14 in which the thread, as a result of an incorrect adjustment of the axial position of the flange-side travel end position 38*a* of the changing movement 36 of the thread relative to the flange 14*a*, is not wound to a sufficient extent in the direction towards the flange 14*a*. The winding member 46 produced consequently tapers at the flange side.

The incorrectly wound flange spools 14 shown in FIGS. 3 and 4 can, when the thread 12 is subsequently removed from the flange spools 14, lead to a thread breakage or to impairments of quality in a product which is intended to be produced from the thread 12.

Figures 5A, 5B:
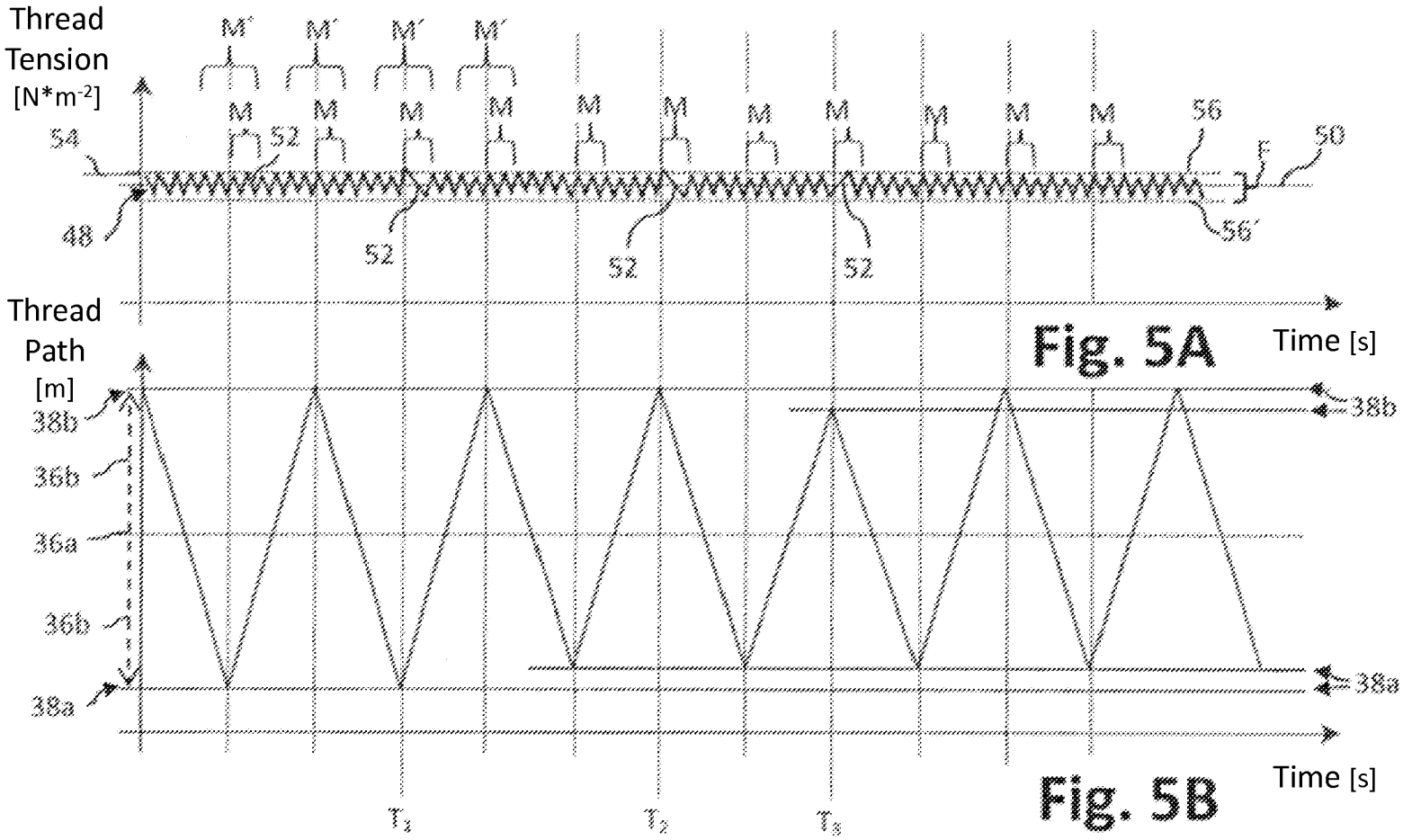
FIG. 5A is a tension graph of the thread tension recorded by the thread tension sensor from FIG. 1 during a spooling operation plotted over time.
FIG. 5B corresponds to FIG. 5A and is a movement graph of the changing thread guide which is recorded at the same time during the spooling operation plotted over time.

FIG. 5A is a tension graph in which the thread tension 48 of the thread 12 is indicated in terms of the path thereof over time. FIG. 5B shows a temporal movement graph of the thread 12 during the spooling operation, which graph is produced at the same time as the thread tension 48. As can be seen from FIG. 5A, the thread tension 48 of the thread 12 to be wound on the flange spool during the spooling operation undulates periodically about a mean thread tension which is designated 50.

The undulating thread tension 48 in this instance has a positive/negative changing rate 52 which remains substantially consistent (in terms of value) and which is illustrated graphically in this instance as a gradient of the thread tension 48. The thread tension 48 has a mean maximum thread tension 54. A predetermined maximum thread tension limit value is designated 56. The maximum thread tension limit value 56 is greater than the mean maximum thread tension 54. A predetermined minimum thread tension limit value is designated 56. The predetermined maximum thread tension limit value 56 and the predetermined minimum thread tension limit value 56' together define a thread tension tolerance range F which is predetermined for the thread tension 48.

At the times T1, T2, the thread tension 48 in the travel end position 38*a*, 38*b* is greater than the maximum thread tension limit value 56 (=tension peak). The thread tension 48 at the times T1, T2 is consequently outside (above) the predetermined thread tension tolerance range F. The thread tension 48 decreases in a predetermined time measurement range M when the changing thread guide 22 is moved away from the adjusted travel end positions 38*a*, 38*b*. The changing rate 52 (=the gradient) of the thread tension 48 when the changing thread guide 22 is moved away from the respective travel end position 38*a*, 38*b*, is smaller in terms of value than a predetermined desired changing rate (not shown). The measurement range M always comprises the time at which the travel end position 38*a*, 38*b* is reached.

The thread tension 48 increases directly after the time T3 when the changing thread guide 22 is moved away from the travel end position 38*b* and has a tension peak which is above and outside the thread tension tolerance range F. The changing rate 52 of the thread tension 48 is in this instance smaller than the predetermined desired changing rate (not shown) of the thread tension 48.

After the time T1, the travel end position 38*a* of the changing movement 36 of the thread 12 during the subsequent spooling operation is arranged further away from the flange 14*a* in an axial direction, that is to say, the flange-side travel 36*b* of the changing thread guide 22 (FIG. 1) is subsequently reduced in comparison with the flange-side travel 36*b* at the time T1. After the tension peak at the time T2, the travel end position 38*b* is spaced axially further away from the associated flange 14*b* (FIGS. 1, 2) than before. That is to say, the flange-side travel 36*b* of the changing thread guide is subsequently reduced in comparison with the travel 36*b* at the time T2. After the time T3, the flange-side travel end position 38*b* is again moved further in an axial direction by means of the changing thread guide towards the flange 14*b* (FIGS. 1 and 2).

According to the invention, the control device is programmed to carry out one of the methods 100 which are explained below with additional reference to FIGS. 6 and 7 for controlling the spooling operation.

Figure 6:
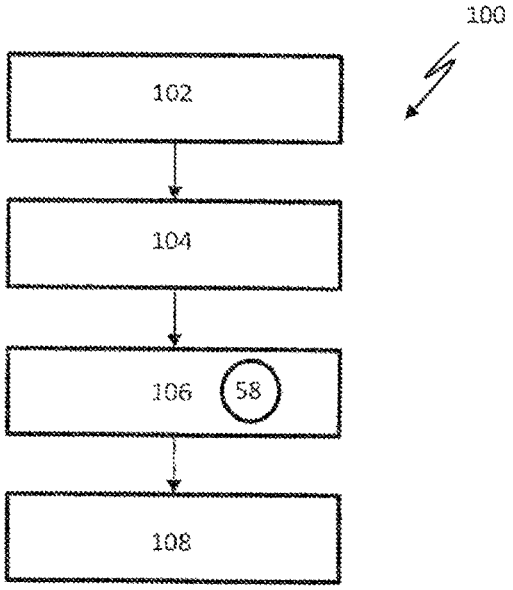
FIG. 6 is a block diagram with individual steps of the method according to the invention for adapting a changing movement of a thread to a flange spool.

In the method 100 set out in FIG. 6, in a first step 102, during the spooling operation, the thread tension 48 of the thread 12 which is intended to be supplied to the flange spool 14 is detected in a time-resolved manner—in this instance continuously—using the thread tension sensor 40. The scanning rate of the thread tension sensor 40 is preferably adapted to the speed of the changing movement 36 of the thread 12 during the spooling operation.

In another step 104, a respective changing rate of the thread tension 48 in the measurement range M when the thread 12 moves away from the flange-side travel end position 38*a*, 38*b* is determined using the thread tension 48 which is detected in a time-resolved manner. The changing rate 52 may in particular be calculated by the control device 26 using the established thread tension 48.

The established changing rate 52 of the thread tension 48 is in another step 106 compared with the desired changing rate 58 of the thread tension 48, which rate is predetermined for the thread tension 48, and a deviation of the changing rate 52 from the predetermined desired changing rate 58 is determined.

In another step 108, the changing movement of the thread 12 is adapted to the flange spool 14 by means of axial adjustment of the flange-side travel end positions 38*a*, 38*b* of the changing thread guide 22 based on the established deviation of the changing rate 52 from the predetermined desired changing rate 58. In the event of a (negative) changing rate 58 with decreasing thread tension 48 and a changing rate 52 of the thread tension 48 which is smaller than the predetermined desired changing rate 58 of the thread tension 48, the travel end position 38*a*, 38*b* of the changing thread guide is moved axially in the direction towards the flange 14*a*, 14*b* (time T3; FIG. 5). In the event of a (positive) changing rate 52 with a thread tension 48 which increases after the travel end position 38*a*, 38*b* has been reached and a changing rate 52 of the thread tension 48 which is greater than the predetermined desired changing rate 58 of the thread tension 48, the flange-side travel end position 38*a*, 38*b* is moved away from the corresponding flange 14*a*, 14*b* of the flange spool 14 in an axial direction (times T1, T2; FIG. 5). A flange-side reversal of the direction of the changing movement 38 of the thread 12 is carried out only subsequently in the following changing period at the reverse location which is adapted to the geometry of the flange spool in each case in the manner described above.

Figure 7:
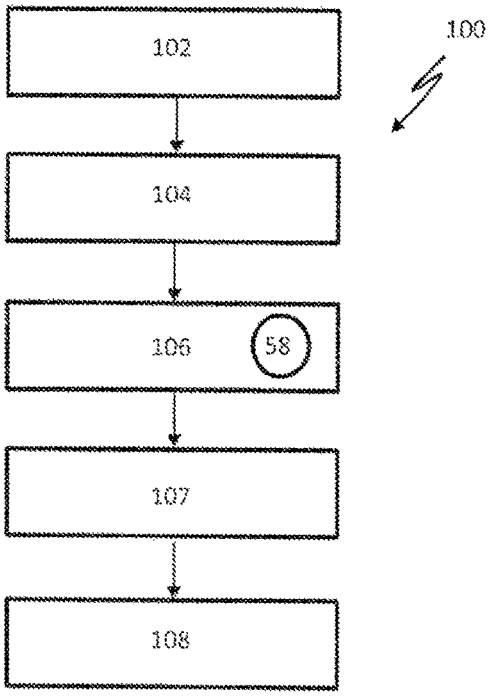
FIG. 7 is a block diagram with individual steps of another method according to the invention for adapting a changing movement of a thread to a thread spool.

The method 100 shown in FIG. 7 differs from the method described above substantially in that, in the step 104, the changing rate 52 of the thread tension 48 is additionally determined also when moving the thread 12 to the flange-side travel end position 38*a*, 38*b* with reference to the thread tension 48 which is detected in a time-resolved manner.

The established changing rate 52 of the thread tension 48 when the thread 12 is moved towards the flange-side travel end position 38*a*, 38*b* and when the thread 12 is moved away from the flange-side travel end position 38*a*, 38*b* is compared in the next step 106 with the desired changing rate 58 of the thread tension 48, which rate is predetermined for the thread tension 48, and a respective deviation of the changing rate 52 from the predetermined desired changing rate 58 is determined. This is carried out over the measurement range M' set out in FIG. 5A.

In another step 107, over the measurement range M' the thread tension 48 when the thread 12 is moved towards the flange-side travel end position 38*a*, 38*b* is compared with the predetermined minimum thread tension limit value 54' and, when the thread 12 is moved away from the flange-side travel end position 38*a*, 38B, is compared with the predetermined maximum thread tension limit value 56 and it is established whether the value is below the minimum thread tension limit value 56' or above the maximum thread tension limit value 56. Alternatively, a thread tension 48 which is located outside the thread tension tolerance range F can also be established by comparing the thread tension 48 with the thread tension tolerance range F explained in connection with FIG. 5A.

In the additional step 108, the changing movement of the thread 12 is adapted to the flange spool 14 by means of axial adjustment of the flange-side travel end positions 38*a*, 38*b* of the changing movement by means of the changing thread guide 22. This is carried out, as already explained in relation to FIG. 6, on the basis of the established deviation of the changing rate 52 from the predetermined desired changing rate 58 and if the value of the thread tension 48 when moving the thread towards the travel end position 38*a*, 38*b* falls below the minimum thread tension limit value 56' and/or the value of the thread tension 48 in the region of the flange-side travel end position 38*a*, 38*b* is greater than the maximum thread tension limit value 56.

Although several embodiments have been described in detail for purposes of illustration, various modifications may be made to each without departing from the scope and spirit of the invention. Accordingly, the invention is not to be limited, except as by the appended claims.

What is claimed is:

1. A method for adapting a travel end position of a changing movement a thread to a flange spool, the thread being moved back and forth during a spooling operation along a rotation axis of the flange spool relative to the flange spool by means of a changing thread guide, the method comprising the following steps of:

time-resolved detecting of a thread tension of the thread which is intended to be spooled on the flange spool;

establishing a changing rate of the thread tension when the thread moves away from a flange-side travel end position of the changing movement using the detected thread tension, the changing rate of the thread tension being averaged over a defined time measurement range;

determining a deviation of the changing rate of the thread tension from a desired changing rate which is predetermined for the thread tension; and adapting the flange-side travel end position by means of axial adjustment of the travel end position and the flange spool relative to each other using the changing thread guide after determining a changing rate of the thread tension which is less than or greater than a predetermined desired changing rate, the flange-side travel end position being moved away from the flange of the flange spool in an axial direction by means of the changing thread guide when the changing rate of the thread tension is negative, that is to say, when the thread tension decreases when the thread is moved away from the flange-side travel end position, and the flange-side travel end position being moved by means of the changing thread guide in an axial direction towards a flange of the flange spool when the changing rate of the thread tension is positive, that is to say, when the thread tension increases when the thread is moved away from the flange-side travel end position.

2. The method according to claim 1, wherein the changing rate of the thread tension is also established using the detected thread tension when the thread is moved towards the flange-side travel end position.

3. The method according to claim 2, wherein the flange-side travel end position is adapted to the flange spool only when the thread tension in the region of the flange-side travel end position deviates in a defined manner from a predetermined thread tension limit value and/or is outside a predetermined thread tension tolerance range.

4. The method according to claim 3, wherein the thread tension limit value is determined using the measured thread tension of the thread during the beginning of the spooling operation.

5. The method according to claim 1, wherein the flange-side travel end position is adapted to the flange spool only when the thread tension in the region of the flange-side travel end position deviates in a defined manner from a predetermined thread tension limit value and/or is outside a predetermined thread tension tolerance range.

6. The method according to claim 5, wherein the thread tension limit value is determined using the measured thread tension of the thread during the beginning of the spooling operation.

7. A spooling device for spooling a thread on a flange spool, the spooling device comprising:

a supply spool for providing the thread which is intended to be spooled on the flange spool;

a yarn spool retention member which can be driven in a continuous manner for the flange spool;

a control device having a thread tension sensor for the time-resolved detection of a thread tension of the thread which is intended to be wound on the flange spool; and a changing thread guide which can be moved back and forth relative to the yarn spool retention member so as to be changed between two travel end positions;

wherein the control device is programmed to carry out a method according to claim 1.

8. The spooling device according to claim 7, wherein the changing thread guide is secured to a continuous pulling means which is guided so as to be able to be moved back and forth around redirection rollers.

* * * * *